US008177956B2

(12) United States Patent
Micyus et al.

(10) Patent No.: US 8,177,956 B2
(45) Date of Patent: May 15, 2012

(54) METHOD OF ELECTROLYTICALLY DISSOLVING NICKEL INTO ELECTROLESS NICKEL PLATING SOLUTIONS

(76) Inventors: Nicole J. Micyus, South Lyon, MI (US); Carl P. Steinecker, South Lyon, MI (US); Duncan P. Beckett, Tamworth (GB)

( * ) Notice: Subject to any disclaimer, the term of this patent is extended or adjusted under 35 U.S.C. 154(b) by 1099 days.

(21) Appl. No.: 12/046,864

(22) Filed: Mar. 12, 2008

(65) Prior Publication Data

US 2009/0232999 A1 Sep. 17, 2009

(51) Int. Cl.
*C25B 1/00* (2006.01)
*B05D 1/18* (2006.01)

(52) U.S. Cl. ..... 205/548; 427/438

(58) Field of Classification Search ..... 427/438; 205/548

See application file for complete search history.

(56) References Cited

U.S. PATENT DOCUMENTS 3,303,111 A * 2/1967 Peach ..... 205/258
5,419,821 A 5/1995 Vaughan
5,522,972 A * 6/1996 Nobel et al. ..... 205/488
5,716,512 A 2/1998 Vaughan
5,944,879 A 8/1999 Martyak
6,379,517 B1 4/2002 Heydecke et al.
6,406,611 B1 6/2002 Engelhaupt et al.
6,852,210 B2 2/2005 Obata et al.
6,861,097 B1 3/2005 Goosey et al.
2005/0241942 A1 11/2005 Heydecke et al.

* cited by examiner

*Primary Examiner* — Arun S Phasge
(74) *Attorney, Agent, or Firm* — Carmody & Torrance LLP

(57) ABSTRACT

A method of extending the lifetime of an electroless nickel plating bath by avoiding the addition of unwanted anions to the process and of improving the pH stability of the bath and minimizing additions of pH correcting additives. The method includes the steps of (a) depositing electroless nickel from an electroless nickel plating bath onto a substrate, wherein the electroless nickel plating bath preferably contains a source of nickel ions and a source of hypophosphite ions; (2) immersing a nickel anode in the plating bath; (3) completing the circuit by utilizing a cathode separated from the nickel bath by an ion exchange membrane and using a catholyte comprising an acid or a salt thereof; and (4) passing a current through the bath. Nickel is dissolved into the plating bath to maintain the nickel concentration and hydrogen is discharged from the cathode.

10 Claims, No Drawings

METHOD OF ELECTROLYTICALLY DISSOLVING NICKEL INTO ELECTROLESS NICKEL PLATING SOLUTIONS

FIELD OF THE INVENTION

The present invention relates to an improved method of replenishing the nickel concentration of an electroless nickel plating bath to avoid the introduction of unwanted anions to the system.

BACKGROUND OF THE INVENTION

Electroless plating refers to the autocatalytic or chemical reduction of metal ions in an aqueous solution to a metal which is deposited on a substrate. Typical electroless plating baths include electroless nickel and electroless copper, by way of example and not limitation. Components of the electroless plating bath include an aqueous solution of metal ions, reducing agents, complexing agents, bath stabilizers and a catalytic agent that operates at a specific metal ion concentration and within the specific temperature and pH range of the system. The base substrate, upon which the metal is plated, is usually catalytic in nature. Thus, the preferred preparation yields a substrate having a catalyzed surface and once the substrate is introduced into the electroless solution, uniform deposition begins. Minute amounts of the metal to be deposited on the substrate, i.e., nickel, further catalyze the reaction. After the original surfaces are coated with metal, the deposition is autocatalytic. Electroless deposition continues, provided that the metal ion and the reducing agent are replenished and the proper pH of the bath is maintained.

Electroless nickel plating generally deposits a nickel alloy onto a substrate which is capable of catalyzing the deposition of this alloy from a process solution containing nickel ions and a suitable chemical reducing agent which is capable of reducing nickel ions in solution to metallic nickel. These reducing agents typically include borohydride and hypophosphite ions. Typically, electroless nickel plating is carried out utilizing hypophosphite ions as the reducing agent. As the hypophosphite reduces the nickel at the catalytic surface, some phosphorus is co-deposited with the nickel yielding a nickel/phosphorus alloy containing between about 1 and 13% phosphorus. This alloy has unique properties in terms of corrosion resistance and (after heat treatment) hardness and wear resistance. Common applications of electroless nickel plating include electronics, computers, valves, aircraft parts, and copier and typewriter parts, by way of example and not limitation. In addition to the unique properties of nickel phosphorus alloys, using a chemical rather than an electrochemical method to produce these alloys has advantages in terms of deposit thickness distribution, giving a very uniform coating when compared to coatings produced by electrochemical methods.

In electroless plating, metal ions are reduced to metal by the action of chemical reducing agents. The reducing agents are oxidized in the process. The catalyst may be the substrate or metallic surface on the substrate, which allows the reduction-oxidation reactions to occur with the ultimate deposition of metal on the substrate.

The metal ion and reducer concentrations must be monitored and closely controlled in order to maintain proper ratios and to maintain the overall chemical balance within the plating bath. The electroless plating deposition rate is controlled by selecting the proper temperature, pH and metal ion/reducer concentrations. Complexing agents may be used as catalyst inhibitors to reduce the potential for spontaneous decomposition of the electroless bath.

The chemical reducing agent most commonly used in electroless plating is sodium hypophosphite, resulting in the generation of nickel phosphorus alloys. Others include sodium borohydride, dimethylamine borane, and N-diethylamine borane, which give nickel boron alloys and hydrazine and hydrogen, which give pure nickel alloys. Electroless nickel plating baths are generally of four types: (1) alkaline nickel phosphorus; (2) acid nickel phosphorus; (3) alkaline nickel boron; and (4) acid nickel boron. There are many potential and actual formulations for hypophosphite, borane and hydrazine reducing baths. However, in all cases the nickel ion is reduced to nickel metal and the reducing agent is mostly oxidized but, to a lesser extent, may also become part of the nickel deposit.

In spite of the many advantages of electroless nickel deposits from an engineering point of view, the deposition of electroless nickel generates significant waste. As the solution ages, it also becomes more viscous and so the plating speed and brightness of the deposit can be reduced. Most of the hypophosphite used to reduce the nickel becomes oxidized to orthophosphite which remains in the process solution and builds up in concentration until the bath must be replaced.

Nickel is maintained in the solution by the addition of a soluble nickel salt, which is typically nickel sulfate, nickel chloride, nickel acetate, nickel hypophosphite or combinations of one or more of the foregoing. The anion builds up and limits the life of the solution, along with the oxidation product from the reducing agent, which is typically orthophosphite. In a conventional system, this means that only about 60 g/L of nickel can be deposited before the concentration of salts reaches the solubility limits. In most commercial processes, the source of nickel is nickel sulfate so the process solution also builds up in sulfate ion. During operation of the bath, the pH tends to fall due to the generation of hydrogen atoms, which must be neutralized by the addition of an alkali such as ammonia, sodium hydroxide or potassium carbonate solutions. Again, these ions build up in concentration during bath operation. Eventually, the bath reaches saturation (or before this the rate of metal deposition becomes too slow for commercial operation) and has to be replaced.

One method of extending bath life is to add nickel to the bath as nickel hypophosphite rather than nickel sulfate. It can be manufactured by dissolution of nickel carbonate into hypophosphorous acid. However, nickel hypophosphite is a relatively expensive material and has limited solubility which gives rise to problems with bath maintenance.

In any electroless bath, an oxidation-reduction reaction occurs which results in oxidation products and metallic nickel. The pH decreases with removal of metal cations leaving anions of the nickel salt or complexing agent and the oxidation products of the reducing agents; i.e., hypophosphite to orthophosphite. The nickel ion and the reducing agent concentrations decrease with deposition. It is essential that the complexing agents, bath stabilizers and other additives remain in the bath at acceptable concentrations as the nickel is being deposited to prevent spontaneous decomposition of the bath and to minimize the number of chemicals that must be monitored and controlled.

Thus it can be seen that currently used electroless nickel baths have a limited life. The pH of the bath must be constantly adjusted with either an acid, usually sulfuric acid, or a base, usually ammonium hydroxide. The combination of hypophosphite oxidation producing orthophosphite and the reduction of nickel ions to metallic nickel usually results in excess acidity, which requires the addition of ammonium hydroxide to obtain the required pH.

The inventors of the present invention have discovered that by immersing a nickel anode either directly or indirectly using a selective ion membrane into the electroless nickel bath and passing an electric current through the bath, preferably using a divided cell arrangement with a perfluorinated cation exchange membrane to separate anolyte and catholyte, the nickel content of the plating bath can be maintained without the introduction of undesirable anions. This enables the bath to be used for more metal turnovers than a conventionally maintained bath which minimizes waste generation and improves consistency of plating rate.

Another unexpected benefit of using the process of the present invention for maintaining the nickel content of the electroless nickel bath is that the pH of the bath is far more stable. With a conventionally maintained electroless nickel bath, the pH of the bath falls during operation and additions of ammonia or potassium carbonate or hydroxide are required, which can sometimes generate localized instability of the bath. In the present invention, the bath is maintained by electrolytic dissolution of nickel and the pH remains relatively constant because the ionic balance of the solution is maintained by transport of hydrogen ions through the cation exchange membrane to the catholyte (to replace the hydrogen ions discharged at the cathode as hydrogen). This also contributes to increased bath life and stability.

SUMMARY OF THE INVENTION

It is an object of the present invention to provide an improved nickel plating bath solution.

It is another object of the present invention to extend the lifetime of an electroless nickel plating bath by avoiding the addition of unwanted anions to the process.

It is still another object of the present invention to improve the pH stability of the bath and minimize additions of pH correcting additives.

To that end, the present invention relates generally to the use of an electrolytic cell to dissolve nickel into an electroless nickel plating solution. The present invention also relates generally to the use of a separate cell for both the cathode, with a membrane to prevent passage of a nickel to the cathode so that no nickel is plated out and the anode so that the other constituents of the bath are not oxidised during the nickel dissolution.

In one embodiment, the present invention relates to a method of maintaining the concentration of nickel ions in a working electroless nickel bath by means of electrolytic dissolution of nickel from a nickel anode immersed in the bath, current being supplied to the anode via a counter electrode consisting of a lead, platinized titanium or iridium/tantalum oxide coated cathode, said cathode being separated from the working bath using a (perfluorinated) ion exchange membrane and utilising a catholyte consisting of sulphuric, phosphoric, phosphorous or hypophosphorous acids or salts.

DESCRIPTION OF THE PREFERRED EMBODIMENTS

The present invention relates to a method of replenishing the nickel content of electroless nickel plating baths by electrolytic dissolution of nickel in the plating bath.

In order to maximize the efficiency of electroless nickel plating baths, it is necessary to minimize additions of unwanted anions.

In one embodiment, the present invention relates to a method of replenishing nickel concentration in an electroless nickel plating bath comprising the steps of:

a) depositing electroless nickel from an electroless nickel plating bath onto a substrate;
b) immersing a nickel anode in the plating bath;
c) completing the circuit by utilizing a cathode separated from the nickel bath by an ion exchange membrane and using a catholyte comprising an acid or a salt thereof; and
d) passing a current through the bath,
whereby nickel is dissolved into the plating bath to maintain the nickel concentration of the bath and hydrogen is discharged from the cathode.

In one embodiment, the nickel plating bath comprises a source of nickel ions and a source of hypophosphite ions. The source of nickel ions can be any suitable source of nickel ions, including for example nickel hypophosphite, but is preferably nickel sulfate.

The catholyte typically comprises an acid selected from the group consisting of sulphuric acid, phosphoric acid, phosphorous acid, hypophosphorous acid and soluble salts.

The nickel anode is typically selected from the group consisting of nickel metal and nickel metal containing additional elements selected from the group consisting of sulphur, phosphorus and carbon. In a preferred embodiment, the nickel anode comprises Nickel S-rounds in titanium basket, and the anode current density is preferably about 30-40 Amps/sq. ft.

The ion exchange membrane is a cation exchange membrane. In a preferred embodiment, the cation exchange membrane is a perfluorinated cation exchange membrane, such as Nafion® ion exchange membranes (available from DuPont de Nemours) or IONAC MC 3470 (manufactured by Sybron Chemicals, Inc. Birmingham, N.J., USA).

The cathode is typically selected from the group consisting of platinized titanium, iridium/tantalum coated titanium and lead. Other suitable cathodes would also be usable in the process of the invention.

The electroless plating bath is typically operated at a temperature in the range of between about 75 and about 95° C. In addition, the cathode current density is typically maintained at about 20-30 Amps/sq. ft.

One of the benefits of the present invention is that the nickel is replenished by a conventional nickel anode, which can be used directly in the tank with the anodic current on, or separated from the solution with a membrane. The ability to replenish the nickel electrolytically can give many advantages, including (1) reducing the cost to the user; (2) as there are no anions introduced with the nickel, the bath life is increased by a factor of 2-3 times; and (3) as the nickel is dissolved electrolytically, the pH in the bath increases which reduces the need for pH correction and reduces the need for the introduction of potentially harmful alkalis.

The cell can be adapted for use with all commonly used tanks, including for example stainless steel, polypropylene and titanium. In addition, the phosphorus in the deposit can vary between about 1-13 percent by weight and/or the boron in the deposit can vary between about 0.1-5 percent by weight.

Furthermore, the deposit produced can be bright to dull depending on customer requirements.

While the invention has been described above with reference to specific embodiments thereof, it is apparent that many changes, modifications, and variations can be made without departing from the inventive concept disclosed here. Accordingly, it is intended to embrace all such changes, modifications, and variations that fall within the spirit and broad scope of the appended claims. All patent applications, patents, and other publications cited herein are incorporated by reference in their entirety.

What is claimed is:

1. A method of replenishing nickel concentration in an electroless nickel plating bath, the method comprising the steps of:

a) depositing electroless nickel from an electroless nickel plating bath onto a substrate;

b) immersing an anode comprising nickel in situ in the plating bath;

c) completing the circuit by utilizing a cathode separated from the electroless nickel plating bath by an ion exchange membrane and using a catholyte comprising an aqueous solution of an acid or a salt; and d) passing a current through the bath, whereby nickel is dissolved into the electroless nickel plating bath.

2. The method according to claim 1, wherein the electroless nickel plating bath comprises a source of nickel ions and a source of hypophosphite ions.

3. The method according to claim 2, wherein the source of nickel ions is nickel sulfate.

4. The method according to claim 1, wherein the catholyte comprises of an acid selected from the group consisting of sulphuric acid, phosphoric acid, phosphorous acid, hypophosphorous acid and soluble salts.

5. The method according to claim 1, wherein the nickel anode is selected from the group consisting of nickel metal and nickel metal containing additional elements selected from the group consisting of sulfur, phosphorus and carbon.

6. The method according to claim 1, wherein the ion exchange membrane comprises a perfluorinated cation exchange membrane.

7. The method according to claim 1, wherein the cathode is selected from the group consisting of platinized titanium, iridium/tantalum coated titanium and lead.

8. The method according to claim 1, wherein the electroless plating bath is operated at a temperature of between about 75 and about 95° C.

9. The method according to claim 1, wherein cathode current density is maintained at about 20-30 A Amps/sq. ft.

10. The method of claim 1, wherein the anode is separated from the electroless nickel plating bath by a second ion exchange membrane.

* * * * *